US007372415B2

(12) United States Patent
Chun

(10) Patent No.: US 7,372,415 B2
(45) Date of Patent: May 13, 2008

(54) GLASS ANTENNA JACK FOR VEHICLE

(75) Inventor: In Sik Chun, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/591,749

(22) Filed: Nov. 1, 2006

(65) Prior Publication Data

US 2008/0007480 A1 Jan. 10, 2008

(30) Foreign Application Priority Data

Jul. 10, 2006 (KR) ..... 10-2006-0064192

(51) Int. Cl.
*H01Q 1/32* (2006.01)

(52) U.S. Cl. ..... 343/713; 343/906

(58) Field of Classification Search ..... 343/711, 343/713, 906; 439/606, 721, 722, 916
See application file for complete search history.

(56) References Cited

U.S. PATENT DOCUMENTS 5,293,177 A * 3/1994 Sakurai et al. ..... 343/906
6,164,984 A * 12/2000 Schreiner ..... 439/86
6,307,515 B1 * 10/2001 Sauer et al. ..... 343/713
6,411,259 B1 * 6/2002 Wendt et al. ..... 343/713
6,445,350 B2 9/2002 Takenobu
6,576,845 B2 * 6/2003 Von Alpen et al. ..... 174/149 R
6,932,620 B2 * 8/2005 Ishiguro et al. ..... 439/66

FOREIGN PATENT DOCUMENTS

| | | |
|---|---|---|
| JP | 09-293550 | 11/1997 |
| JP | 2001-313513 | 11/2001 |
| KR | 10-1997-0013400 | 4/1997 |
| KR | 100240711 B1 | 10/1999 |

* cited by examiner

*Primary Examiner*—Hoang V Nguyen
(74) *Attorney, Agent, or Firm*—Peter F. Corless; Edwards Angell Palmer & Dodge LLP

(57) ABSTRACT

Disclosed are a glass antenna jack for a vehicle comprising a jack connector, a jack terminal, and a locking structure engaging the jack connector and the jack terminal and a vehicle comprising the same.

33 Claims, 5 Drawing Sheets

GLASS ANTENNA JACK FOR VEHICLE

CROSS-REFERENCE TO RELATED APPLICATIONS

This application claims priority from Korean Patent Application No. 10-2006-0064192, filed on Jul. 10, 2006 with the Korean Intellectual Property Office, the disclosure of which is incorporated herein by reference.

BACKGROUND OF INVENTION

1. Field of Invention

The present invention relates to a glass antenna jack of a vehicle, more particularly, to a glass antenna jack equipped with a locking structure between a connector and a terminal of the jack, which allows the connector and the terminal to be readily and firmly engaged.

2. Background

A vehicle is generally provided with an antenna for receiving signals from a broadcasting station such as AM/FM radio, TV and the like. In terms of a position to be installed and the appearance thereof, antennas can be categorized into pole antennas and glass antennas. Pole antennas are typically in shape of rod and projected from a body of a vehicle in an upright position. By contrast, as shown in FIG. 8, glass antennas are typically mounted or printed on a rear glass and/or a window glass.

Conventionally, while pole antennas have been widely used as antennas for transmitting and receiving radio waves of car telephones and portable telephones and receiving television broadcast waves, since the construction of these pole antennas requires them to protrude from the vehicle body, there have been caused drawbacks that the protrusion of the antennas is not preferable from safety and aesthetic appearance aspects and that the protruding antenna constitutes a disturbance and may be broken when washing a vehicle.

Due to this, in recent years, there have been demands for antennas with no protrusion such as glass antennas in which an antenna pattern is directly printed on a window glass of a vehicle and antennas in which a seal or sheet on which an antenna pattern is printed is affixed to a window glass of a vehicle, and those antennas have now been put to practical use.

In a conventional glass antenna system, the glass antenna is combined with a defogging or defrosting wire within a rear glass of a vehicle. Such a glass antenna system is necessarily provided with a device for coupling a printed antenna pattern, which is formed of thin conductive material like copper foil, to an electric cable via which received radio signals are transferred to a radio system of the vehicle. The device is a so-called glass antenna jack.

A glass antenna jack is typically furnished with a terminal coupled to a contact point of the antenna pattern, and a connector coupled to the electric cable.

Referring to FIGS. 6 and 7, a conventional glass antenna jack is briefly described. The conventional glass antenna jack includes a jack connector 10 and a jack terminal 26, coupling between which is achieved by inserting a couple of inwardly concave plates 48 into contact point portions 50 of slit type. Specifically, the connection between the concave plates 48 and the contact point portions 50 can be readily rendered by inserting the concave plates 48 into openings of the jack terminal 26, and subsequently rotating the jack connector 10 with respect to the jack terminal 26 so that the concave plates 48 forcibly fits into the slits of the contact point portions 50.

However, in the coupling between the conventional connector and the terminal, if an inserting force applied to the connector is excessive, the concave plates of the connector can be damaged, even though the concave plates are normally coupled to the contact point portions of the terminal. Moreover, the concave plates of the connector can be easily separated from the contact point portions of the terminal.

Numerous structures of glass antenna jack have been proposed for use with vehicles. For example, Japanese Patent Laid-open No. 2001-313513 published on Nov. 09, 2001 discloses a terminal device for a glass antenna, in which buried portions of metal legs are electrically connected to two input terminals of a four terminal circuit on a circuit board, and a connector supporting portion is provided at an upper side of a buried portion of a resin-molded main body, and electrodes of the connector are respectively connected to two output terminals of the four terminal circuit.

Further, Japanese Patent Laid-open No. 1997-293550 published on Nov. 11, 1997 discloses a tap terminal comprising a base for installing a conductive metal plate which is securely connected to an antenna conductor or a heat coil formed at a window of a car, a terminal piece which is detachably connected to a connector of a lead wire connected to a power source, and a condenser which is detachably interposed between the base and the terminal piece, wherein the condenser is covered along with a part of the base and the terminal piece by a housing.

Furthermore, Korean Patent Laid-open No. 1999-021716 published on Mar. 25, 1999 discloses a terminal connecting device of a rear window glass antenna, comprising an antenna terminal which is protruded to an inner surface of a rear window glass so as to be electrically connected to the rear window glass antenna, a head lining which has a coupling hole formed at a rear place thereof so as to be placed in a position opposite to the antenna terminal and which is disposed at a lower side of a roof panel, and a connector assembly which is connected through the coupling hole of the head lining to the antenna terminal and also connected to a wiring at an inside of the head lining.

Furthermore, Korean Patent Laid-open No. 1998-076620 published on Nov. 16, 1998 discloses a terminal for a window glass antenna of vehicle, comprising a terminal housing which is formed with a plurality of terminal inserting holes respectively spaced at regular intervals and which has terminals respectively inserted into the terminal inserting holes, and a connector which has connecting terminals corresponding to the number of terminals installed in the terminal housing.

Nonetheless, the foregoing glass antenna jacks are disadvantageous in that coupling the connector and the terminal is labor-intensive work in the light of the structure thereof, which leads to decrease of the productivity. Therefore, there is a need for a glass antenna jack having an improved structure capable of securely and readily coupling the connector and the terminal.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

In one aspect, a glass antenna jack for a vehicle is provided comprising: (i) a jack connector which comprises an insulated body having one or more inserting holes passing through the insulated body vertically, wherein the insulated body of the jack connector has one or more coupling portions with one or more coupling holes at a distal end of each of the coupling portions; and (ii) a jack terminal which comprises an insulating base having one or more terminals, wherein the insulating base of the jack terminal has one or more protrusions at one or more surfaces of the insulating base and the protrusions are adapted for fitting into the coupling holes of the coupling portions.

In another aspect, a glass antenna jack for a vehicle is provided comprising: (i) a jack connector which comprises an insulated body having one or more inserting holes passing through the insulated body vertically; (ii) a jack terminal which comprises an insulating base having one or more terminals; and (iii) a conductive plate between the jack connector and the jack terminal, which comprises one or more inserting portions and one or more conductive fastening portions, wherein the inserting portions are adapted for being connected to the inserting holes of the jack connector and the conductive fastening portions are adapted for being connected to one or more terminals of the jack terminal.

In a further aspect, a glass antenna jack for a vehicle is provided which comprises: (i) a jack connector comprising an insulated body having one or more inserting holes passing through the insulated body vertically, a coupling portion downwardly extending from a lower portion of the insulated body, and a conductive plate having one or more conductive fastening portions therein and being adapted for fitting into the inserting holes; and (ii) a jack terminal comprising an insulating base, one or more first terminals projected from both sides of the insulating base, which are adapted for being connected to contact portions of an antenna pattern, and one or more second terminals protruded upward from an upper surface of the insulated base, wherein the second terminals are in electrically communication with the first terminals and are adapted for being connected to the conductive fastening portion.

In a still further aspect, motor vehicles are provided that comprise a described glass antenna jack.

It is understood that the term "vehicle" or other similar term as used herein is inclusive of motor vehicles in general such as passenger automobiles, buses, trucks, various commercial vehicles, and the like.

Other aspects of the invention are discussed infra.

BRIEF DESCRIPTION OF THE DRAWINGS

The above and/or other aspects and advantages of the prevent invention will become apparent and more readily appreciated from the following description of the exemplary embodiments, taken in conjunction with the accompany drawings, in which.

DETAILED DESCRIPTION OF THE EMBODIMENTS OF THE INVENTION

Figure 1:
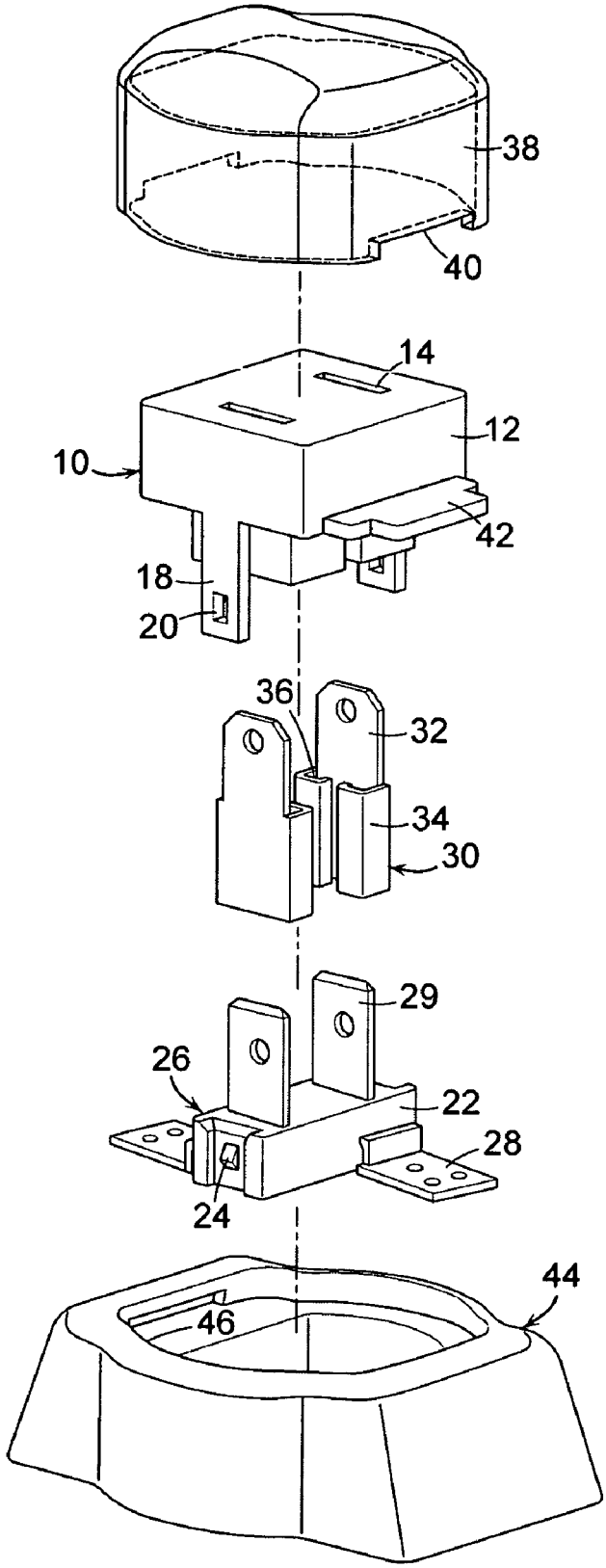
FIG. 1 is an exploded perspective view of a glass antenna jack for vehicle according to the present invention.

As discussed above, in one aspect, a glass antenna jack for a vehicle is provided comprising: (i) a jack connector which comprises an insulated body having one or more inserting holes passing through the insulated body vertically, wherein the insulated body of the jack connector has one or more coupling portions with one or more coupling holes at a distal end of each of the coupling portions; and (ii) a jack terminal which comprises an insulating base having one or more terminals, wherein the insulating base of the jack terminal has one or more protrusions at one or more surfaces of the insulating base and the protrusions are adapted for fitting into the coupling holes of the coupling portions.

Preferably, the coupling portions may downwardly extend from a lower portion of the insulated body.

Also preferably, the jack terminal may have (i) one or more first terminals horizontally protruded from one or more side portions of the insulating base and (ii) one or more second terminals vertically protruded from the upper portion of the insulating base. More preferably, the second terminals may be connected to the inserting holes of the connector.

In a preferred glass antenna jack, the protrusions may be formed at a front and/or a rear surface of the insulating base.

In another preferred glass antenna jack, the insulated body of the jack connector may further have one or more protruded portions at one or more sides of the insulated body.

Another preferred glass antenna jack may further comprise an upper cover for covering the insulated body. The upper cover can be of any type of structures that can cover the insulated body. Preferably, a lower surface of the upper cover may be opened and partially cut-away portions may be formed along a lower circumference of the upper cover so that the cut-away portions can fit into the protruded portions.

A still another preferred glass antenna jack may further comprise a lower cover for covering the insulating base. The lower cover also can be of any type of structures that can cover the insulating base. Preferably, the lower cover may have a receiving space at an upper side thereof, which is adapted for stably accommodating the insulating base.

In another aspect, the present invention provides a glass antenna jack for a vehicle comprising: (i) a jack connector which comprises an insulated body having one or more inserting holes passing through the insulated body vertically; (ii) a jack terminal which comprises an insulating base having one or more terminals; and (iii) a conductive plate between the jack connector and the jack terminal, which comprises one or more inserting portions and one or more conductive fastening portions, wherein the inserting portions are adapted for being connected to the inserting holes of the jack connector and the conductive fastening portions are adapted for being connected to one or more terminals of the jack terminal.

Preferably, the jack terminal may have (i) one or more first terminals horizontally protruded from one or more side portions of the insulating base and (ii) one or more second terminals vertically protruded from the upper portion of the insulating base.

In a preferred glass antenna jack, one or more of the second terminals may be connected to the conductive fastening portions of the conductive plate.

In another preferred glass antenna jack, the conductive fastening portion can be an integral part of the conductive plate. For example, it can be formed by inwardly rolling edge of the conductive plate.

Suitably, the insulated body of the jack connector may have one or more coupling portions with one or more coupling holes defined at a distal end of each of the coupling portions. In a particular preferred embodiment, the coupling portions may downwardly extend from a lower portion of the insulated body.

In yet another preferred glass antenna jack, the insulating base of the jack terminal may have one or more protrusions at one or more surfaces of the insulating base. Preferably, these protrusions are adapted for fitting into the coupling holes of the coupling portions. More preferably, the protrusions can be formed at a front and rear surfaces of the insulating base.

In a further preferred glass antenna jack, the insulated body of the jack connector may further have one or more protruded portions at one or more sides of the insulated body.

A still another preferred glass antenna jack may further comprise an upper cover for covering the insulated body. The upper cover can be of any type of structures that can cover the insulated body. Preferably, a lower surface of the upper cover may be opened and partially cut-away portions may be formed along a lower circumference of the upper cover so that the cut-away portions can fit into the protruded portions.

A still further preferred glass antenna jack may further comprise a lower cover for covering the insulating base. The lower cover also can be of any type of structures that can cover the insulating base. Preferably, the lower cover may have a receiving space at an upper side thereof, which is adapted for stably accommodating the insulating base.

In a further aspect, a glass antenna jack for a vehicle is provided, which comprises: (i) a jack connector comprising an insulated body having one or more inserting holes passing through the insulated body vertically, a coupling portion downwardly extending from a lower portion of the insulated body, and a conductive plate having one or more conductive fastening portions therein and being adapted for fitting into the inserting holes; and (ii) a jack terminal comprising an insulating base, one or more first terminals projected from both sides of the insulating base, which are adapted for being connected to contact portions of an antenna pattern, and one or more second terminals protruded upward from an upper surface of the insulated base, wherein the second terminals are in electrically communication with the first terminals and are adapted for being connected to the conductive fastening portion.

Preferably, one or more coupling holes can be formed at a distal end of each coupling portion of the insulated body, and one or more protrusions can be integrally formed at a front and rear surfaces of the insulating base so that the protrusions can be inserted into the coupling holes.

Suitably, the insulated body of the jack connector may further comprise one or more protruded portions at one or more sides of the insulated body.

A preferred glass antenna jack may further comprise an upper cover for covering the insulated body. The upper cover can be of any type of structures that can cover the insulated body. Preferably, a lower surface of the upper cover may be opened and partially cut-away portions may be formed along a lower circumference of the upper cover so that the cut-away portions can fit into the protruded portions.

Another preferred glass antenna jack may further comprise a lower cover for covering the insulating base. The lower cover also can be of any type of structures that can cover the insulating base. Preferably, the lower cover may have a receiving space at an upper side thereof, which is adapted for stably accommodating the insulating base.

In a still further aspect, motor vehicles are provided that comprise a described glass antenna jack.

Reference will now be made in detail to the preferred embodiment of the present invention, examples of which are illustrated in the accompanying drawings, wherein like reference numerals refer to like elements throughout. The embodiments are described below so as to explain the present invention by referring to the figures.

Figure 2:
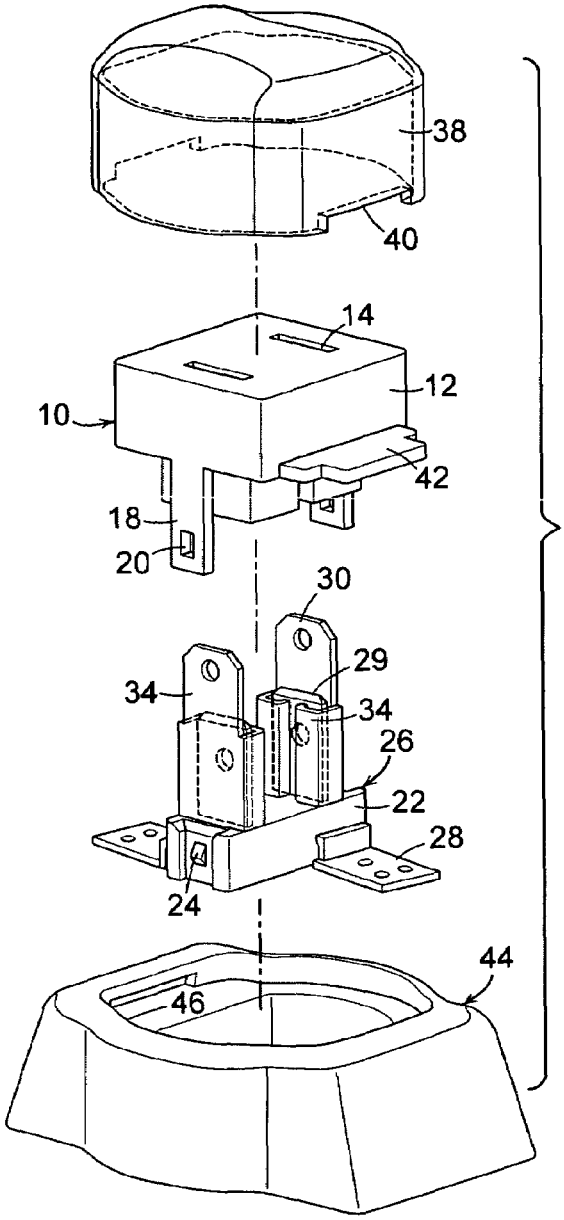
FIGS. 2 and 3 are assembled perspective views of the glass antenna jack for vehicle according to the present invention.
Figure 3:
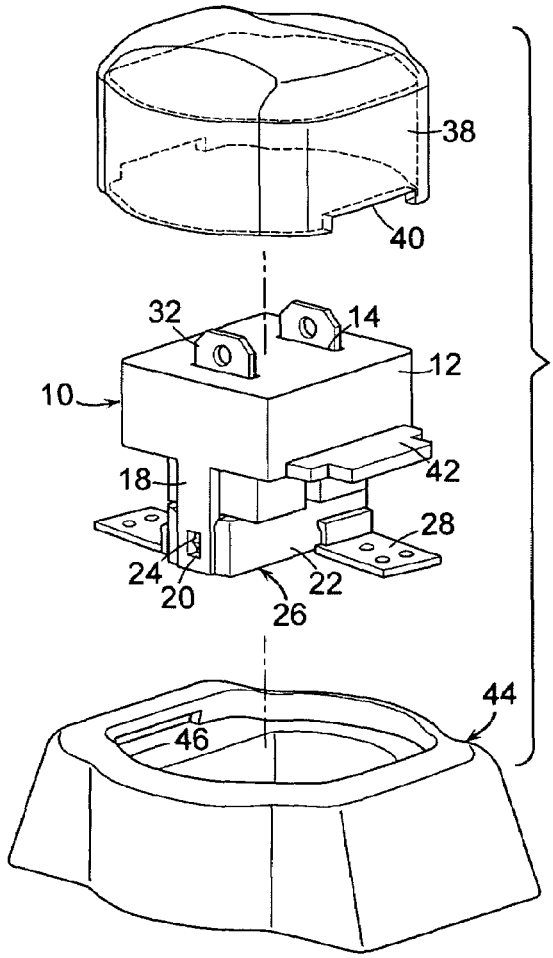
Figure 4:
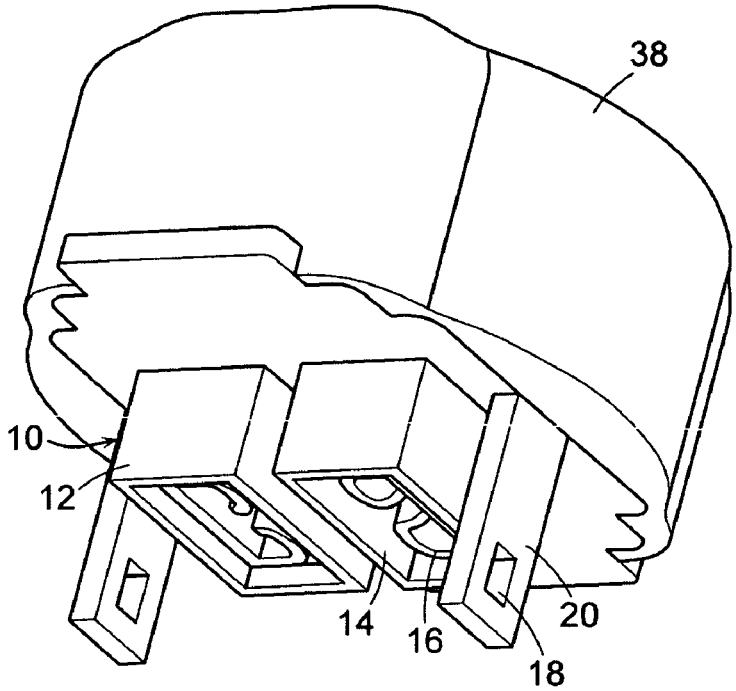
FIG. 4 is a lower perspective view of a jack terminal of the glass antenna jack for vehicle according to the present invention.
Figure 5:
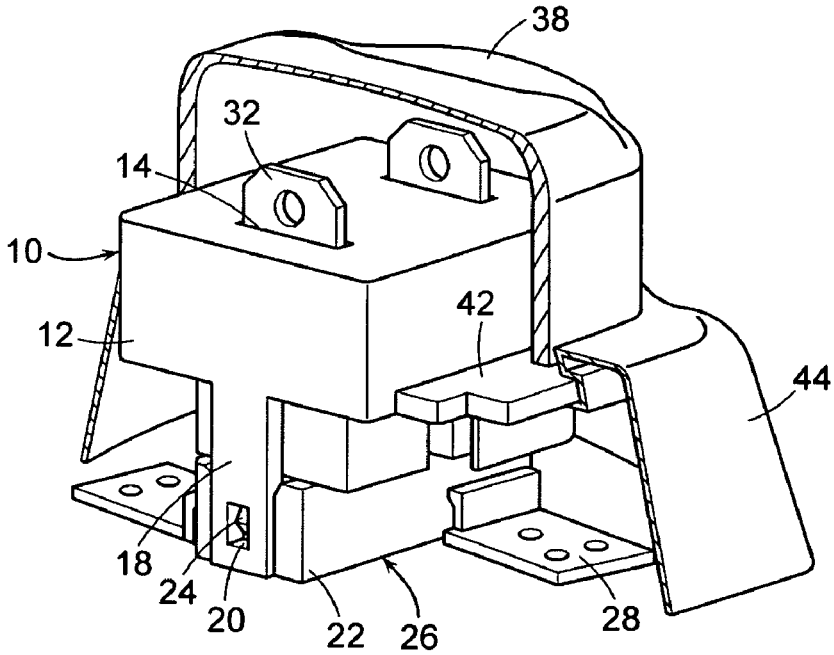
FIG. 5 an assembled perspective view of the glass antenna jack for vehicle, which is partially cut away, according to the present invention.
Figure 6:
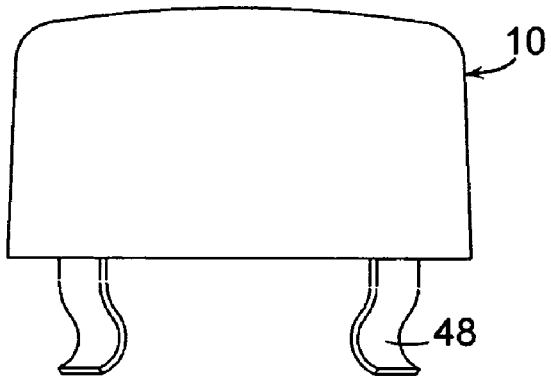
FIGS. 6 to 8 are schematic views showing a conventional glass antenna for vehicle.
Figure 7:
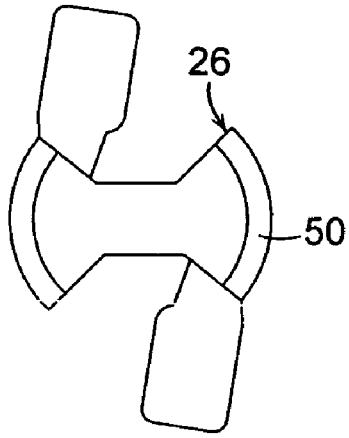
Figure 8:
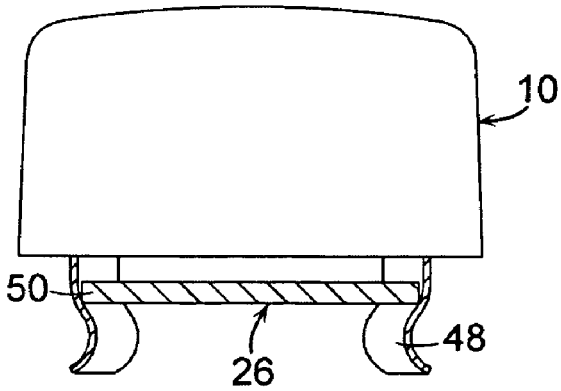
Figure 9:
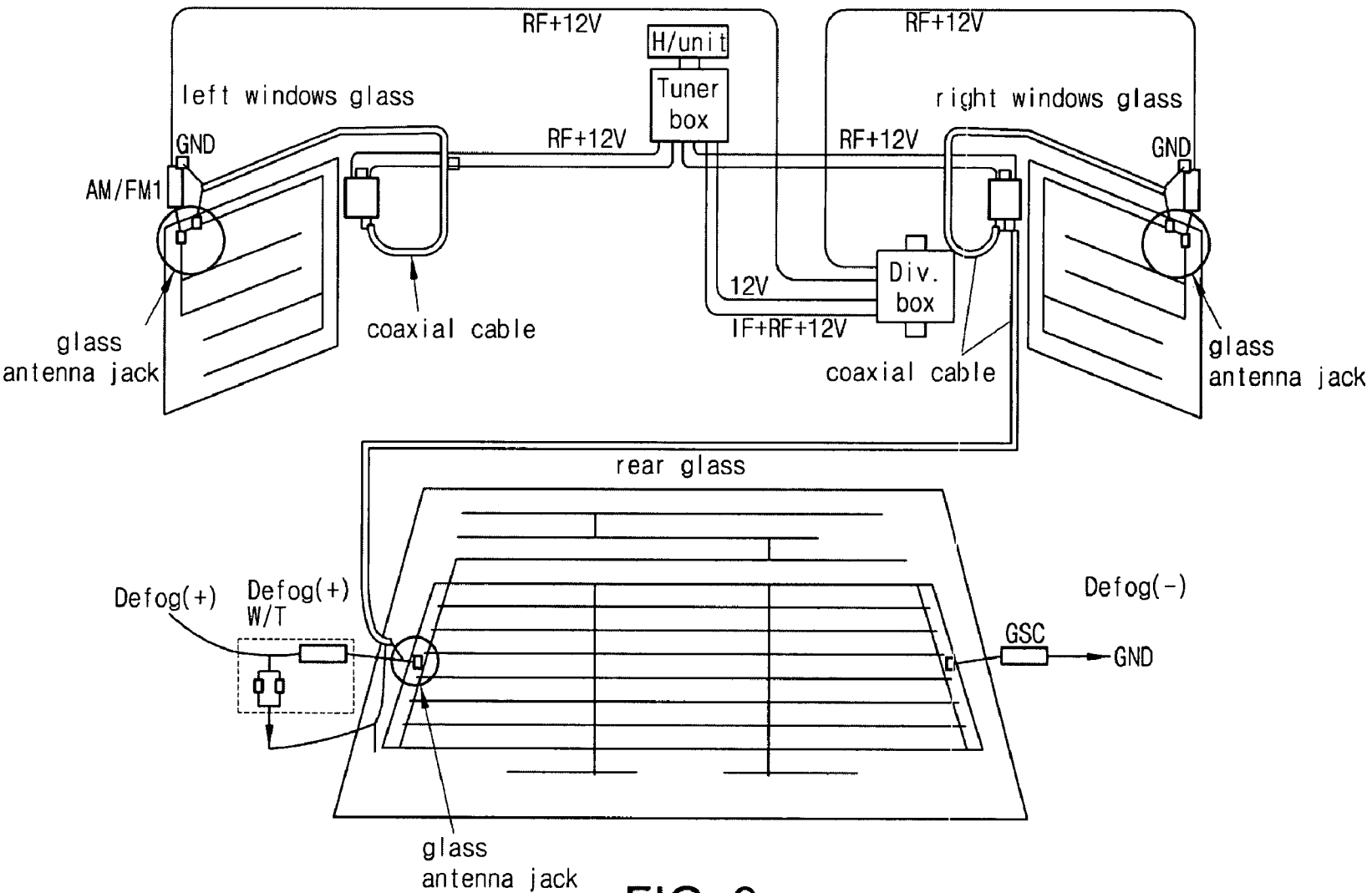
FIG. 9 is a schematic view showing an installing position of the glass antenna jack.

FIG. 1 is an exploded perspective view of a glass antenna jack for vehicle according to the present invention. FIGS. 2 and 3 are assembled perspective views of the glass antenna jack for vehicle according to the present invention. FIG. 4 is a lower perspective view of a jack terminal of the glass antenna jack for vehicle according to the present invention, and FIG. 5 is an assembled perspective view of the glass antenna jack for vehicle, which is partially cut away, according to the present invention.

A glass antenna jack of the present invention mainly comprises a jack connector and a jack terminal.

Firstly, a construction of the jack connector will be described.

The jack connector 10 has an insulated body 12 as a main framework. The insulated body 12 is preferably formed with a pair of inserting holes 14 passing through the insulated body 12 vertically. Suitably, the jack connector 10 is provided with a conductive plate 30, which includes a conductive inserting portion 32 which is configured to be inserted in each of the inserting holes 14.

Preferably, a coupling portion 18 can be integrally formed with the insulated body 12 downwardly extending from a lower portion of a front and rear surface thereof. Suitably, formed on the distal end of the coupling portion 18 is a coupling hole 20, which is configured to engage with a protrusion 24 of an insulating base 22 to be described later.

Now, a construction of the jack terminal will be described.

The jack terminal 26 has an insulating base 22 as a main framework. The insulating base 22 comprises first terminals 28 and second terminals 29.

Preferably, the first terminals 28 to be coupled to contact portions of an antennae pattern may be formed at a lower portion of both sides of the insulating base 22 while being laterally projected from the insulating base 22. Suitably, a pair of the second terminals 29 are protruded upward from an upper surface of the insulated base 22.

In the arrangement, the first terminals 28 and the second terminals 29 may be in electrically communication with each other at the inside of the insulating base 22.

As described above, protrusions 24 to be inserted in the coupling holes 20 formed at the coupling portions 18 may be integrally formed at the front and rear surface of the insulating base 22.

Next, a construction of the conductive plate will be described.

The conductive plate 30 functions in not only electrically connecting the jack connector 10 and the jack terminal 26, but also mechanically securing the engagement between the jack connector 10 and the jack terminal 26.

The conductive plate 30 is a conductive structure, which may comprise a pair of conductive inserting portions 32 placed at the upper portion thereof and a pair of conductive fastening portions 34 disposed at the lower portion thereof. Preferably, the conductive inserting portions 32 are inserted into the inserting holes 14 of the insulated body 12. Suitably, the conductive fastening portions 34 can be formed by inwardly rolled edge of the conductive plate 30 such that the second terminals 29 are inserted and firmly secured therein.

With such an arrangement, the second terminals 29 of the jack terminal 26 may be inserted into gaps 36 formed in the conductive fastening portions 34, thereby achieving the coupling between the jack terminal 26 and the main terminal 30.

Also preferably, the conductive inserting portions 32 of the conductive plate 30 may be inserted into the inserting holes 14 of the jack connector 10, thereby achieving the coupling between the main terminal 30 and the jack connector 10.

Finally, the protrusion 24 of the jack terminal 26 is snap-fitted with the coupling hole 20, thereby achieving the coupling between the jack connector 10 and the jack terminal 26.

Suitably, the insulated body 12 may be furnished with an upper cover 38 for aesthetically pleasing appearance. The upper cover 38 may comprise an opened lower surface and cut-away portions 40 formed along a lower circumference thereof at opposite sides so that protruded portions 42 formed at each lower end of both sides of the insulated body 12 can fit into the cut-away portions 40.

Likewise, the insulating base 22 may be covered by a lower cover 44. Preferably, the lower cover 44 may comprise a receiving space 46 at an upper side thereof for stably and invisibly accommodating the insulating base 22.

Consequently, when completing the fabrication of the glass antenna jack according to the present invention, most of the elements may be concealed by the upper cover 38 and the lower cover 44, whereby accomplishing the aesthetically pleasing outer appearance.

As described above, the glass antenna jack according to the present invention is advantageous over prior arts in that the engagement of the connector and the terminal can be readily rendered and firmly maintained by applying a locking mechanism to the terminal and the connector themselves. Further, since the coupling structure between the terminal and the connector of the glass antenna jack according to the present invention can be securely held by the locking structure, the terminal and the connector cannot be easily separated from each other.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A glass antenna jack for a vehicle, which comprises:

(i) a jack connector comprising an insulated body having one or more inserting holes passing through the insulated body vertically, a coupling portion downwardly extending from a lower portion of the insulated body, and a conductive plate having one or more conductive fastening portions therein and being adapted for fitting into the inserting holes; and (ii) a jack terminal comprising an insulating base, one or more first terminals projected from both sides of the insulating base, which are adapted for being connected to contact portions of an antenna pattern, and one or more second terminals protruded upward from an upper surface of the insulated base, wherein the second terminals are in electrically communication with the first terminals and are adapted for being connected to the conductive fastening portion.

2. The glass antenna jack according to claim 1, wherein one or more coupling holes are formed at a distal end of each coupling portion of the insulated body, and one or more protrusions are integrally formed at a front and rear surfaces of the insulating base so that the protrusions can be inserted into the coupling holes.

3. The glass antenna jack according to claim 1, wherein the insulated body of the jack connector further has one or more protruded portions at one or more sides of the insulated body.

4. The glass antenna jack according to claim 1, further comprising an upper cover for covering the insulated body.

5. The glass antenna jack according to claim 4, wherein a lower surface of the upper cover is opened and partially cut-away portions are formed along a lower circumference of the upper cover so that the cut-away portions can fit into the protruded portions.

6. The glass antenna jack according to claim 1, further comprising a lower cover for covering the insulating base.

7. The glass antenna jack according to claim 6, wherein the lower cover has a receiving space at an upper side thereof adapted for stably accommodating the insulating base.

8. A vehicle comprising a glass antenna jack of claim 1.

9. A glass antenna jack for a vehicle, comprising:

(i) a jack connector which comprises an insulated body having one or more inserting holes passing through the insulated body vertically, wherein the insulated body of the jack connector has one or more coupling portions with one or more coupling holes at a distal end of each of the coupling portions; and (ii) a jack terminal which comprises an insulating base having one or more terminals, wherein the insulating base of the jack terminal has one or more protrusions at one or more surfaces of the insulating base and the protrusions are adapted for fitting into the coupling holes of the coupling portions.

10. The glass antenna jack according to claim 9, wherein the coupling portions downwardly extend from a lower portion of the insulated body.

11. The glass antenna jack according to claim 9, wherein the jack terminal has one or more first terminals horizontally protruded from one or more side portions of the insulating base and one or more second terminals vertically protruded from the upper portion of the insulating base.

12. The glass antenna jack according to claim 11, wherein the second terminals are connected to the inserting holes of the connector.

13. The glass antenna jack according to claim 9, wherein the protrusions are formed at a front and rear surfaces of the insulating base.

14. The glass antenna jack according to claim 9, wherein the insulated body of the jack connector further has one or more protruded portions at one or more sides of the insulated body.

15. The glass antenna jack according to claim 9, further comprising an upper cover for covering the insulated body.

16. The glass antenna jack according to claim 15, wherein a lower surface of the upper cover is opened and partially cut-away portions are formed along a lower circumference of the upper cover so that the cut-away portions can fit into the protruded portions.

17. The glass antenna jack according to claim 9, further comprising a lower cover for covering the insulating base.

18. The glass antenna jack according to claim 17, wherein the lower cover has a receiving space at an upper side thereof adapted for stably accommodating the insulating base.

19. A vehicle comprising a glass antenna jack of claim 9.

20. A glass antenna jack for a vehicle, comprising:

(i) a jack connector which comprises an insulated body having one or more inserting holes passing through the insulated body vertically;

(ii) a jack terminal which comprises an insulating base having one or more terminals; and (iii) a conductive plate between the jack connector and the jack terminal, which comprises one or more inserting portions and one or more conductive fastening portions, wherein the inserting portions are adapted for being connected to the inserting holes of the jack connector and the conductive fastening portions are adapted for being connected to the one or more terminals of the jack terminal.

21. The glass antenna jack according to claim 20, wherein the jack terminal has one or more first terminals horizontally protruded from one or more side portions of the insulating base and one or more second terminals vertically protruded from the upper portion of the insulating base.

22. The glass antenna jack according to claim 21, wherein the second terminals are connected to the conductive fastening portions.

23. The glass antenna jack according to claim 20, wherein the conductive fastening portion of the conductive plate is formed by inwardly rolling edge of the conductive plate.

24. The glass antenna jack according to claim 20, wherein the insulated body of the jack connector has one or more coupling portions with one or more coupling holes at a distal end of each of the coupling portions.

25. The glass antenna jack according to claim 24, wherein the coupling portions downwardly extend from a lower portion of the insulated body.

26. The glass antenna jack according to claim 20, wherein the insulating base of the jack terminal has one or more protrusions at one or more surfaces of the insulating base and the protrusions are adapted for fitting into the coupling holes of the coupling portions.

27. The glass antenna jack according to claim 26, wherein the protrusions are formed at a front and rear surfaces of the insulating base.

28. The glass antenna jack according to claim 20, wherein the insulated body of the jack connector further has one or more protruded portions at one or more sides of the insulated body.

29. The glass antenna jack according to claim 20, further comprising an upper cover for covering the insulated body.

30. The glass antenna jack according to claim 29, wherein a lower surface of the upper cover is opened and partially cut-away portions are formed along a lower circumference of the upper cover so that the cut-away portions can fit into the protruded portions.

31. The glass antenna jack according to claim 20, further comprising a lower cover for covering the insulating base.

32. The glass antenna jack according to claim 31, wherein the lower cover has a receiving space at an upper side thereof adapted for stably accommodating the insulating base.

33. A vehicle comprising a glass antenna jack of claim 20.

* * * * *